United States Patent [19]

Engel

[11] Patent Number: 4,503,364

[45] Date of Patent: Mar. 5, 1985

[54] PROGRAMMING AND CONTROL DEVICE FOR MODIFIED LEAD BALLAST FOR HID LAMPS

[75] Inventor: Joseph C. Engel, Monroeville, Pa.

[73] Assignee: Cooper Industries, Inc., Houston, Tex.

[21] Appl. No.: 617,824

[22] Filed: Jun. 5, 1984

Related U.S. Application Data

[63] Continuation of Ser. No. 414,115, Sep. 2, 1982, abandoned.

[51] Int. Cl.[3] ..... G05F 1/00; H05B 37/02

[52] U.S. Cl. ..... 315/308; 315/208; 315/239; 315/276; 315/283; 315/291; 315/307; 315/DIG. 4

[58] Field of Search ..... 315/308, 224, 307, 208, 315/239, 276, 283, 291, DIG. 4

[56] References Cited

U.S. PATENT DOCUMENTS

| | | | |
|---|---|---|---|
| 3,265,930 | 8/1966 | Powell | 315/209 |
| 3,344,311 | 9/1967 | Nuckolls | 315/199 |
| 3,590,316 | 6/1971 | Engel et al. | 315/209 R |
| 4,156,166 | 5/1979 | Shapiro et al. | 315/308 |
| 4,162,429 | 7/1979 | Elms et al. | 315/284 |
| 4,204,141 | 5/1980 | Nuver | 315/307 |
| 4,292,570 | 9/1981 | Engel | 315/360 |
| 4,356,433 | 10/1982 | Linden | 315/308 |

OTHER PUBLICATIONS

"Modern Techniques of Analog Multiplications", by Tom Cate, Electronic Engineer, Apr., 1970, pp. 75–79.

*Primary Examiner*—Harold Dixon

*Attorney, Agent, or Firm*—Spensley, Horn, Jubas & Lubitz

[57] ABSTRACT

Improved programming and control device for modified lead ballast for HID lamp. The basic ballast comprises a high reactive transformer and capacitor connected intermediate the transformer and lamp. An additional inductor and AC switch connect in parallel with the capacitor and the switch is opened and closed to vary the lamp current to control lamp output. The improved device comprises a parameter measuring means which measures a lamp operating parameter and converts same into output electrical signals. These signals are compared to a reference signal to generate error signals. The error signals are integrated by a capacitor and a potential which is indicative of the integrated signals is slowly developed at one capacitor terminal. A ramp capacitor is charged each half cycle of energizing potential. When the ramp capacitor potential crosses over the potential displayed at the one terminal of the integrating capacitor, a comparator means generates an output signal. The output signal actuates a gate drive to turn a gate-controlled AC switch "ON", which decreases the current to the lamp for the remainder of the half cycle. When the apparatus is initially energized, the potential at the one terminal of the integrating capacitor never crosses the ramp capacitor potential so that the device initially is inoperative. The potential at the integrating capacitor terminal is then slowly changed by the integrated error signals to reflect to magnitude of the integrated error signals. Thus, the improved device is not effective until the lamp is normally operating.

9 Claims, 14 Drawing Figures

PROGRAMMING AND CONTROL DEVICE FOR MODIFIED LEAD BALLAST FOR HID LAMPS

This application is a continuation of Ser. No. 414,115 filed Sept. 2, 1982, now abandoned.

CROSS-REFERENCES TO RELATED APPLICATIONS

In copending application Ser. No. 414,114, filed concurrently herewith, and now abandoned, is disclosed a ballast modifying device and a modified lead-type ballast for programming and controlling the operating performance of an HID lamp. This copending application is a continuation-in-part of application Ser. No. 282,993, filed July 14, 1981 now abandoned which in turn is a continuation-in-part of application Ser. No. 264,324, filed May 18, 1981, all applications being by R. J. Spreadbury and owned by the present assignee.

In copending application Ser. No. 414,275, filed concurrently herewith by Engel et al. now U.S. Pat. No. 4,455,595 issued 6-19-84 and owned by the present assignee is disclosed an improved packaging concept for a programming and control device wherein all elements thereof are included in a unitary package formed similarly to a capacitor can of such dimensions as to be readily mounted in existing HID lamp fixture designs.

In copending application Ser. No. 414,276, filed concurrently herewith by Bhalla et al. now U.S. Pat. No. 4,475,065 is disclosed a modified method for operating an HID sodium lamp wherein lamp voltage rise, which is normally encountered throughout lamp life, is minimized in order to minimize the lamp source color shifts which are normally encountered with some types of HID sodium lamps.

BACKGROUND OF THE INVENTION

This invention relates to an improved programming and control device for a modified lead ballast for HID lamps and particularly for HID sodium lamps.

The basic modifying device for a lead ballast is disclosed in the aforementioned application Ser. No. 282,993, filed July 14, 1981 by R. J. Spreadbury now abandoned. In its preferred form, a series-connected additional inductor and a gate-controlled AC switch are connected in parallel across the capacitor of the lead ballast and a sensing and programming means operates to sense at least one lamp operating parameter to control the proportion of time the AC switch is opened and closed, in order to vary the current input to the lamp. The programming and control device of the present application has been specifically tailored to operate with such a modifying apparatus for a lead-type ballast.

Electronic control of ballasted discharge lamps is well known and an early development in the field is U.S. Pat. No. 3,265,930 dated Aug. 9, 1966 to Powell wherein current is sensed to develop a signal which drives a switching means between a high impedance state and a low impedance state in order to control the power input to the discharge device. Another development is set forth in U.S. Pat. No. 3,344,310 dated Sept. 26, 1967 to Nuckolls wherein a variety of lamp operating parameters can be sensed in order to control the operation of the discharge lamp. These include a line current responsive control, a voltage responsive control, a light output responsive control and a lamp load current responsive control.

A further development is set forth in U.S. Pat. No. 3,590,316, dated June 29, 1971 to Engel et al. wherein an electronic wattmeter is utilized to measure the operating lamp wattage and this is converted into a phase controlled signal in order to maintain the lamp operating wattage at a predetermined value. Another system for controlling lamp wattage is disclosed in U.S. Pat. No. 4,162,429, dated July 24, 1979 to Elms et al. wherein lamp voltage and line voltage are sensed and these parameters are converted into separate current signals which are fed into a ramp capacitor to control the charging rate thereof. When the ramp capacitor achieves a predetermined level of charge during each half cycle of AC energizing potential, an AC switch is gated to shift the current level to the operating lamp, in order to control the wattage input thereto.

There are several different systems of multiplying electric signals and some of these are summarized in "Modern Techniques of Analog Multiplication", The Electronic Engineer, April 1970, pages 75–79, article by Cate. These multiplied signals can be used as part of an electronic wattmeter.

It is known to dim high-intensity-discharge lamps for the latter part of the night when less illumination is needed, in order to conserve energy, and such a system is disclosed in U.S. Pat. No. 4,292,570, dated Sept. 29, 1981 to Engel.

SUMMARY OF THE INVENTION

The present improved sensing and programming means operates in combination with a conventional lead-type ballast apparatus for an HID lamp. The basic lead-type ballast has input terminals adapted to be connected across a source of AC energizing potential and output terminals across which the lamp to be operated is adapted to be connected. The basic ballast comprises an inductive reactive portion and a capacitive reactive portion. The inductive reactance portion comprises a current-limiting high-reactance transformer having a primary winding connected to the apparatus input terminals and a secondary winding terminating in secondary winding output terminals. The capacitive reactance portion of the ballast comprises a capacitor connected between the secondary winding output terminals and the apparatus output terminals. This basic lead-type ballast is modified by having a series-connected additional inductance and gate-controlled AC semiconductor switch connected in parallel with the capacitor of the basic ballast. There is also provided a sensing and programming means which is operable to sense at least one predetermined lamp operating parameter and to generate an output control signal which is indicative of a parameter desired for the operating lamp. The sensing and programming means has its output connected to the gate of the AC switching means in order to control the relative proportion of time the switching means is open and closed in order to control in programmed fashion the lamp operating parameter desired. This is the preferred form of the basic device which is disclosed in aforementioned abandoned application Ser. No. 282,993, filed July 14, 1981.

The present improved sensing and programming means comprises a parameter measuring means which is operable to periodically measure the value of the lamp operating parameter to be controlled and to convert the periodically measured values of the parameter into output electrical signals of a magnitude which varies in accordance with the measured values of the parameter.

The resulting electric signals are applied to an error signal generating means which compares the electric signals to a reference signal in order to generate error signals which are indicative of whether the measured values of the parameter are equal to or less than or greater than the desired value for the measured parameter. An integrating capacitor means has one terminal portion which is connected to receive the generated error signals. Upon initial energization of the apparatus, the one terminal portion of the integrating capacitor means exhibits a predetermined potential which is thereafter slowly modified by the received error signals in order to exhibit a potential which is indicative of the magnitude of the integrated error signals. A ramp capacitor means includes a ramp capacitor which exhibits a gradual changing potential each half cycle of the AC energizing potential and the gradually changing potential normally crosses over that value of potential developed at the one terminal portion of the integrating capacitor means when it is indicative of the magnitude of the integrated error signals. During lamp start-up and warm-up, however, the gradually changing ramp capacitor potential never crosses over that predetermined potential which is exhibited at the one terminal portion of the integrating capacitor means. A comparator means compares the potential at the one terminal of the integrating capacitor means with the potential developed across the ramp capacitor means, in order to generate a comparator signal output whenever the changing potential of the ramp capacitor crosses over the integrated error signal potential exhibited at the one terminal portion of the integrating capacitor means. The comparator signal output is applied to a gate drive means which generates a drive signal to turn the gate controlled AC switching means "ON". Thus, during lamp start-up and warm-up, the AC switching means is maintained in an "OFF" condition and this prevents the application of high voltages developed across the ballast capacitor during lamp start-up and warm-up from being applied across the additional inductance means.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENTS

Figure 1:
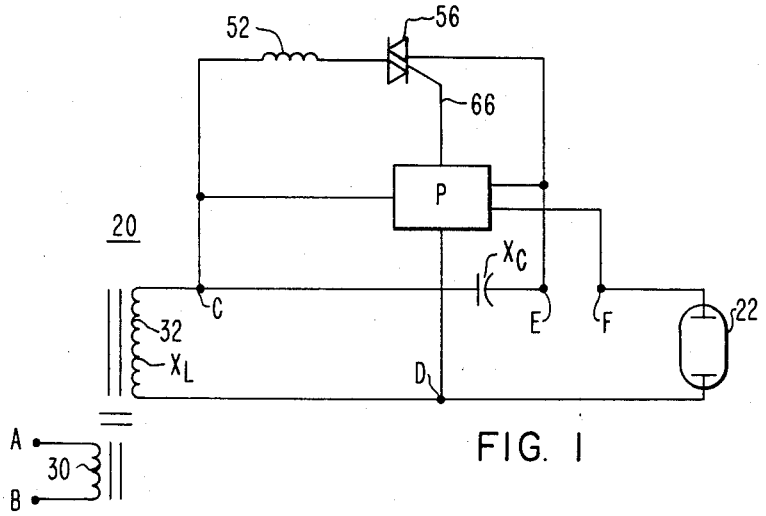
FIG. 1 is a diagram showing the general circuit arrangement for the preferred embodiment of the present invention.

The basic lead ballast circuit which is modified to incorporate a controlling module is shown in FIG. 1. This circuit can be used to operate any type of high-intensity-discharge lamp including HID metal halide lamps or HID sodium lamps, but it is particularly adapted to operate the sodium lamp because of the substantial voltage increases which such lamps normally exhibit throughout their life. In the embodiment as shown, the basic lead-type ballast apparatus 20 has apparatus input terminals A and B adapted to be connected across a source of AC energizing potential and apparatus output terminals F and D across which the lamp 22 to be operated is adapted to be connected. The apparatus comprises an inductive reactance portion designated $X_L$ and a capacitive reactance portion designated $X_C$. The inductive reactance portion comprises a conventional current-limiting high-reactance transformer means which has a primary winding 30 connected to the apparatus input terminals A and B and a second winding 32 terminating in secondary winding output terminals C and D. The capacitive reactance portion comprises the capacitor $X_C$ connected between the secondary winding means output terminal C and the terminal E and, as will be described hereinafter, the output terminal E connects to the apparatus output terminal F through a copper strip on a printed circuit board. In conventional fashion, the high reactance transformer $X_L$ can have an autotransformer construction or it can be formed with separate windings. The basic modifying device comprises additional inductance means 52 connected in series with a gate-controlled AC semiconductor switching means 56 which has a high impedance open position and a low impedance closed position and gate terminal means 66 which connect to the basic sensing and programming means P as described hereinafter. When the switching means 56 is open, the modified ballast apparatus delivers a first level of current to an operating lamp and when the switching means is closed, the modified ballast apparatus delivers a second and lower level of current to an operating lamp. The sensing and programming means P is operable to sense at least one predetermined lamp operating parameter and to generate an output control signal which is indicative of a predetermined parameter desired for the operating lamp. The programming means has its output connected to the gate terminal 66 of the switch 56 to control the relative proportion of time the switching means is open and closed in order to control in programmed fashion the predetermined lamp operating parameter desired for the operating lamp.

In accordance with the present invention, the improved sensing and programming means is operable to periodically measure the value of the lamp operating parameter to be controlled and to convert the measured values of the parameter into output electrical signals of a magnitude which varies in accordance with the measured values of the parameter. In one preferred embodiment, the lamp parameter which is sensed is the lamp operating wattage and the resulting signals are used to control the operating wattage of the lamp, in order that the lamp operating wattage is maintained at about a predetermined set value.

Figure 2:
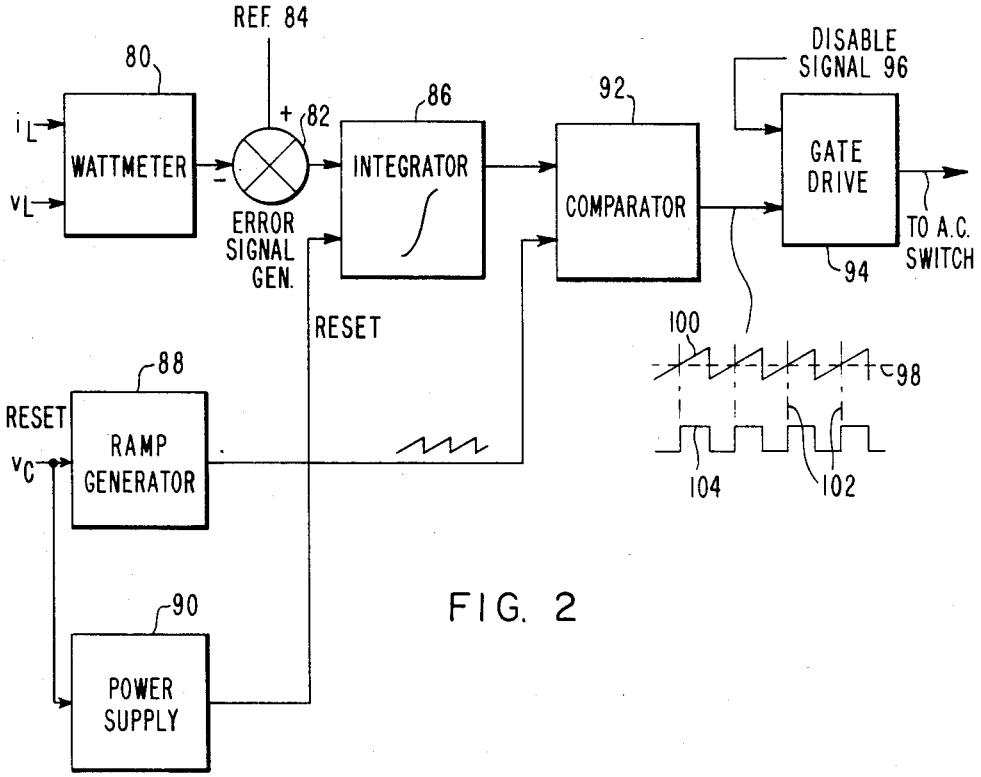
FIG. 2 is a block circuit diagram for the preferred embodiment of the present improved sensing and programming means.

FIG. 2 sets forth a block diagram of the basic control circuitry which is connected in such manner as to control the lamp wattage. The lamp current ($i_L$) and lamp voltage ($V_L$) are sensed and are multiplied in an electronic wattmeter 80 in order to generate a series of output electrical signals of a magnitude which varies in accordance with the measured values of the lamp wattage. These signals are then compared in an error signal generating means 82 to a reference signal 84 in order to generate error signals which are indicative of whether the measured values of the wattage are equal to or less than or greater than the desired value for the measured lamp wattage. The resulting error signals are fed into an integrator 86 which comprises an integrating capacitor, described hereinafter, having one terminal portion connected to receive the generated error signals. When the apparatus is initially energized, the one terminal portion of the integrating capacitor will exhibit a predetermined potential which is thereafter slowly modified by the received error signals to a potential which is indicative of the magnitude of the integrated error signals. The power supply is derived from the potential drop ($v_C$) across the lead ballast capacitor $X_C$ (see FIG. 1) and if this potential drops below a predetermined value during operation, the integrating capacitor will be reset to its initial value, as explained hereinafter, in order to prevent gate drive signals.

A ramp generator means 88 causes a ramp capacitor, described hereinafter, to exhibit a gradually changing potential each half cycle of the AC energizing potential. The gradually changing ramp capacitor potential normally crosses over that potential developed at the one terminal portion of the integrating capacitor which is indicative of the magnitude of the indicated error signals. However, the gradually changing ramp capacitor potential never crosses over that predetermined potential which is exhibited at the one terminal portion of the integrating capacitor when the apparatus is initially energized or when the integrating capacitor is reset due to a drop in sensed potential ($V_C$) at the power supply 90.

A comparator means 92 compares the potential at the one terminal portion of the integrating capacitor with the potential developed across the ramp capacitor in order to generate a comparator signal output whenever the changing potential of the ramp capacitor crosses over the integrated error-signal potential displayed at the one terminal portion of the integrating capacitor. The resulting comparator signal output actuates a gate drive means 94 to generate a gate drive signal to turn the AC switching means "ON". In order to conserve power consumed by the control circuitry, once the switching means is turned "ON", a disabling circuit, described hereinafter, is responsive to current flow through the switching means to generate a disable signal 96 to render the gate drive means inoperative, thereby reducing power requirements therefor. In the voltage-phase relationships which exist between the comparator 92 and the gate drive 94 shown in FIG. 2, the potential exhibited at the one terminal of the integrating capacitor is shown in dashed lines 98 with the cross-over points of the ramp capacitor potential 100 indicated in solid lines 102 so that the comparative voltage values are converted to a phase controlled signal 104 for actuation of the AC switch 56 (FIG. 1).

POWER REGULATING MODULE

Figure 3:
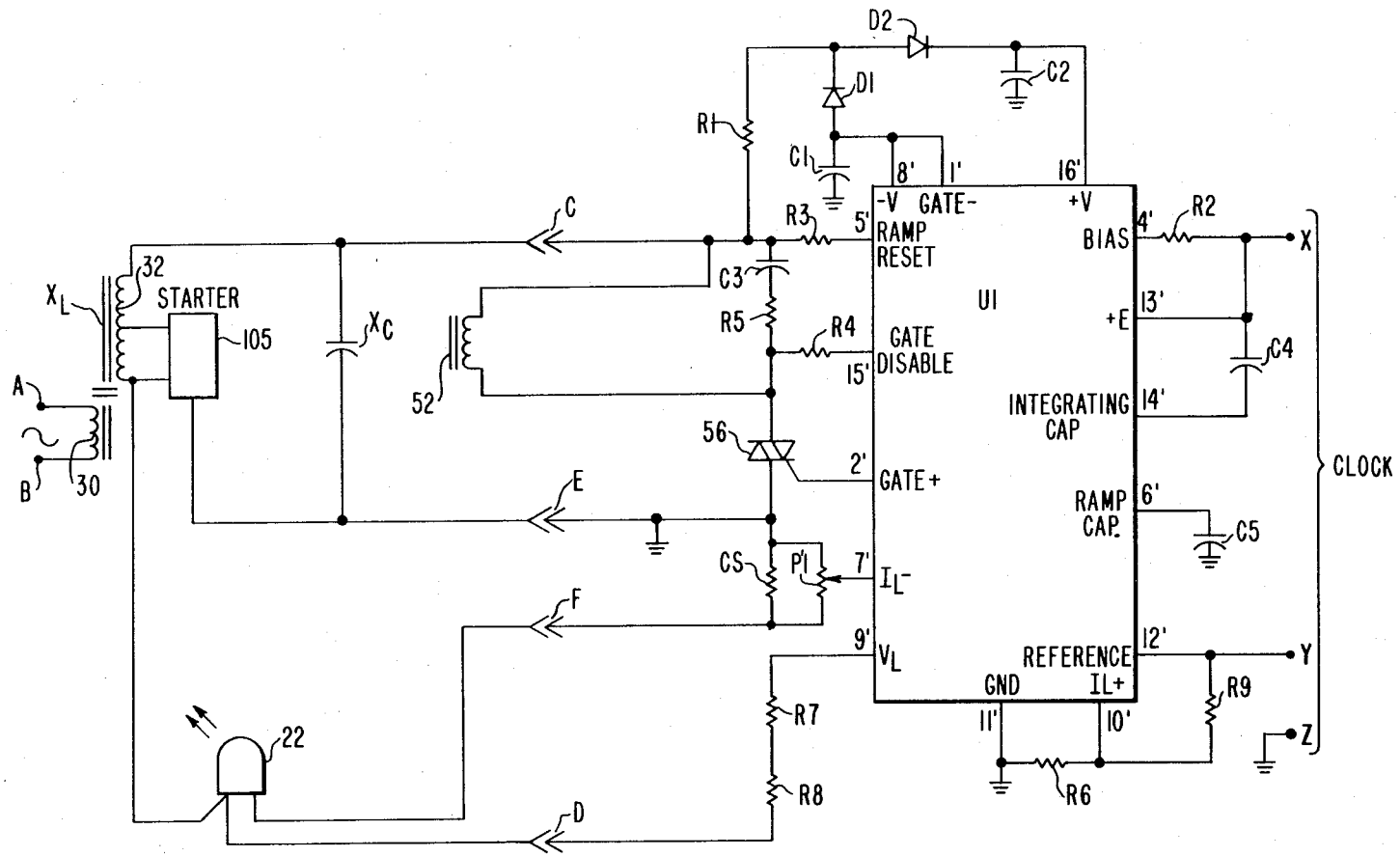
FIG. 3 is a circuit diagram of the present sensing and programming means when it is formed as a power regulating module.

In FIG. 3 is shown the schematic diagram for the power regulating module. The circuit is designed around a 16 pin semi-custom integrated circuit U1 which will be described in detail hereinafter and the functional outline of this circuit has been shown in FIG. 2. More specifically, the circuit connections between the power regulating module and the conventional ballasting components are shown as connection points C, D, E and F. The high reactance transformer $X_L$ has its primary winding 30 adapted to be connected to the power input terminals A, B and a conventional starter circuit 105 cooperates with the secondary winding 32 to provide a high voltage starting pulse, such as 2,500 volts. A wide variety of these starting circuits are available and a typical circuit is described in U.S. Pat. No. 4,072,878, dated Feb. 7, 1978.

As previously described, lamp current and lamp voltage are sensed and are fed to the multiplier circuit which computes the instantaneous lamp power, with the resulting signal compared to a reference value. The resulting error signal is fed into an integrating capacitor which has a DC voltage output which slowly increases if the desired power exceeds the actual value. If the lamp power is too large, the capacitor voltage will slowly decrease. The integrating capacitor voltage is compared to a voltage ramp signal and the comparator output feeds the AC switch gate current generating circuit. The gate current signal can exist whenever the ramp generator voltage exceeds the capacitor voltage and once the AC switch 56 is turned on, a signal is produced by the switch anode voltage such that the gate current is turned off, in order to minimize power supply requirements.

The power supply for the unit is generated by the voltage across the ballast capacitor $X_C$ and the zero crossing points of the ballast capacitor voltage are used to reset or synchronize the ramp generator. As indicated hereinbefore, if the supply voltage is too low, the integrating capacitor is reset to a reference voltage which exceeds the maximum ramp generator voltage in order to ensure that the gate current is turned off, which in turn permits the power supply voltage to increase. This feature also ensures that the gate current is zero immediately after the regulator is turned on and during lamp warm-up, in order to minimize the size and voltage requirements for the additional inductor 52.

When the regulator portion of the module is operating in normal fashion, the AC switch 56 is "phase controlled" in such manner that the inductor current increases whenever the lamp power consumption exceeds the desired value and this has the effect of decreasing the lamp current, which in turn decreases the lamp power. Capacitor $C_3$ and resistor $R_5$ are used to limit the AC switch dV/dt at turn-off while also providing latching and hold-on current at turn-on.

In the operation of the module, the lamp current is sensed by the 20 milliohm current shunt CS which is formed by a copper track on the printed circuit board, as will be described in more detail hereinafter. The 0.4%/°C. temperature coefficient of the track CS is compensated by the negative coefficient of the input transistors in the multiplier so that the device is temperature compensated. Potentiometer $P'_1$ is used to adjust the lamp power which covers a range of from about 100 watts to 400 watts. The lamp voltage is sensed by means of the resistors $R_7$ and $R_8$ and two series resistors are used because of the 2500 volt, 3 μsec. lamp starting pulse which appears across these resistors.

Resistor $R_3$ provides the current which is used to synchronize the ramp generator. The generator is reset whenever the current through $R_3$ drops below about 30 μA, which corresponds to about 150 V. The 30 μA reference is approximately twice the bias current which flows through $R_2$ into BIAS terminal 4'. The voltage at the BIAS terminal 4' is about 0.7 V (forward biased diode) while the voltage at the +E terminal, 13', is abut 7.4 V. The difference appears across $R_2$.

The ramp capacitor $C_5$ is charged by a constant current out of RAMP CAP, terminal 6' which equals twice the current into the BIAS terminal 4'.

The error detector integrating capacitor $C_4$ is connected between the +E terminal 13' and the INTEGRATING CAP terminal 14'. Thus, when the unit is initially turned on and $C_4$ is discharged, the voltage at terminal 14' is +E which exceeds the maximum ramp capacitor voltage. As previously indicated, this ensures that the AC switch is not turned on. The comparator circuit senses the voltage between RAMP CAP terminal 6' and INTEGRATING CAP terminal 14'.

The gate current for the AC switch 56 is produced by current flowing into the GATE+, terminal 2', whenever the comparator circuit requests current and the gate disable signal is not present. The disabling signal is produced by current flow into or out of the GATE DISABLE terminal 15'. The magnitude of this current must exceed the bias current. The gate current magnitude is about 200 mA, established by the chip U1, but lasts only several microseconds. This results in an average current of about 100 μA, which simplifies the design of the power supply.

The power supply is established by current flow through $R_1$. During the positive half cycle of the ballast capacitor voltage, the current flows through $D_2$ into the parallel combination of $C_2$ and a shunt Zener reference of about 10.9 V within the chip U1 located between the +V terminal 16' and the GND, terminal 11'. During the negative half cycle, the current flows through $D_1$ from $C_1$ and a shunt Zener reference of about −7.4 V between −V terminal 8' and the GND, terminal 11'. The gate current flows from the GATE, terminal 1' into the negative side of $C_1$.

A precise power reference signal is produced by a constant voltage which is generated by the chip $U_1$ at the REFERENCE terminal 12' in combination with a resistor $R_9$ (and $R_4$, if the clock is used). The current flow from the REF terminal 12' is used internally as the chip power reference signal.

Resistor $R_6$, connected between $I_L$+, terminal 10' and GND is used as an internal zero offset correction for the chips multiplier.

The counter or clock which will be described hereinafter connects to the circuit at terminals X, Y and Z.

In the following Table I is set forth the parts list for the power regulating module as shown in FIG. 3.

TABLE I

| | POWER REGULATING MODULE | | | | |
|---|---|---|---|---|---|
| | VALUE | | | | |
| COMP DESCRIPTION | Ω | | | MFG. NUMBER | MFG. |
| R1 Resistor | 100K | 5% | 2 W | | |
| R2 Resistor | 1.5 M | 5% | .25 W | | |
| R3 Resistor | 4.7 M | 5% | .25 W | | |
| R4 Resistor | 4.7 M | 5% | .25 W | | |
| R5 Resistor | 2K | 5% | .25 W | | |
| R6 Resistor | 300 | 5% | .25 W | | |
| R7 Resistor | 1 M | 5% | 1 W | | |
| R8 Resistor | 1 M | 5% | 1 W | | |
| R9 Resistor | 1 M | 5% | .25 W | | |
| C1 Capacitor | 18 MFD | 20% | 15 V | 196D186X0015JA1 | Sprague |
| C2 Capacitor | 18 MFD | 20% | 15 V | 196D186X0015JA1 | Sprague |
| C3 Capacitor | .028 MFD | 5% | 600 V | 715P2856LD3 | Sprague |
| C4 Capacitor | 1 MFD | 10% | 50 V | RA1A105K | IMB |
| C5 Capacitor | .015 MFD | 20% | 50 V | CW15-50-100-M | Central Lab |
| D1 Diode | 400 mA | | 225 V | 1N645 | Gen Inst |
| D2 Diode | 400 mA | | 225 V | 1N645 | Gen Inst |
| P'1 Potentiometer | 200 | 10% | 1 Turn | 3386-P-1-201 | Bourns |
| 56 AC Switch | 4 A | | 600 V | Q6004 L4 | Teccor |
| U1 Integrated Ckt | | | | MOA2953 | Interdesign |
| Printed Circuit Board | | | | A81158 | |
| Terminals | | | | 62409-1 | AMP |

SEMI-CUSTOM INTEGRATED CIRCUIT

The I.C. design is based upon a "master array" concept which yields silicon wafers with thousands of identical "chips" which are completely processed except for the final device interconnect pattern on the surface of the chip. When the pattern is etched into the aluminum surface, the chip forms the unique circuit desired. The process can be compared to that of having a printed circuit board assembled with a large number of components (approximately 300) such as resistors, diodes, and NPN and PNP transistors before the copper of the PC board has been etched to form the circuit. The advantage of this process is reduced cost and development time. The circuit for the processed chip is shown in detail in FIGS. 4 and 5 wherein both figures are identical except that different portions of these circuits have been delineated by blocks to facilitate the description thereof. Each of the blocks as shown on the circuit diagram will be considered hereinafter.

Power Supply

Figure 4:
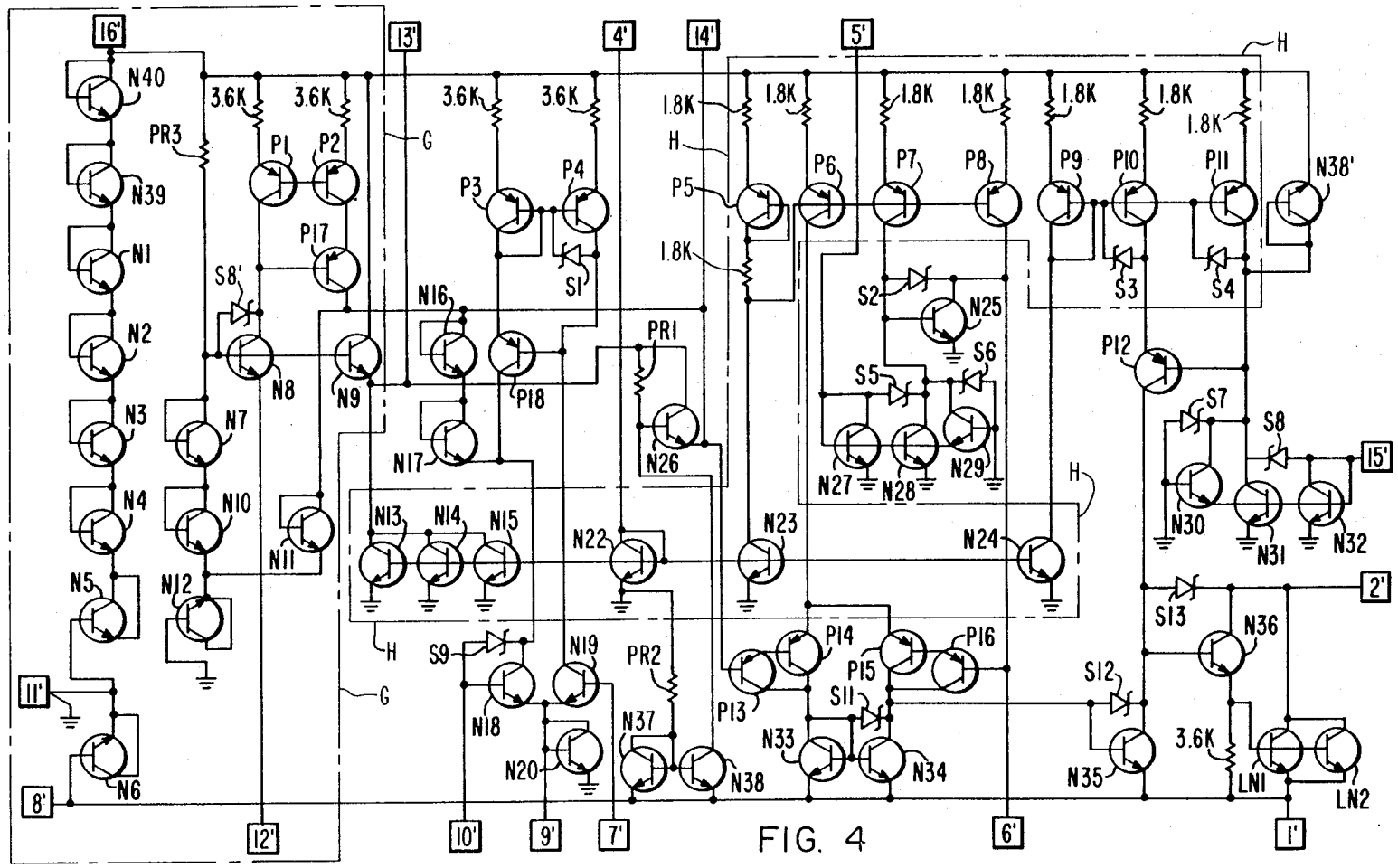
FIG. 4 is a circuit diagram of the I.C. chip portion of the module with separate sections shown for the power supply and bias current supply portions thereof.

Referring to FIG. 4, the power supply is identified by block G. Simple positive Zener (transistors N40, N39 and N1–5) and negative Zener (transistor N6) networks are used with external circuitry to establish voltage limited power supplies for the I.C. A stable reference voltage is established at REFERENCE terminal 12' by means of transistors N7, N8, N10 and N12 as well as the 100K PR3 resistor. This reference is temperature stabilized as the positive coefficient of Zener connected N12 cancels the negative coefficient of diode connected N10 while the diode configuration of N7 cancels the base to emitter drop of transistor N8. The effect of ripple current and thus ripple voltage at +V terminal 16' is minimized as the small ripple current through the 100K PR3 resistor causes a negligible ripple in the reference voltage.

Transistor N8 is configured in a common base manner such that the emitter current of N8 (the external current flow out of REFERENCE terminal 12') approximately equals the collector current. This current is "mirrored" by the transistors P1, P2 and P17 such that the reference current flows toward the INTEGRATING CAP terminal 14'. A voltage source is produced at +E terminal 13', which can source (and sink) as much as 3 Ib (bias current).

Bias Current Supply

The bias current supply is shown in block H in FIG. 4. The current into BIAS terminal 12' is used, by means of current mirrors, to generate a total of one current sink and five current souces which are used by various parts of the I.C. The current sink is formed by N13, N14 and N15 and is connected to +E terminal 13'. Three current sources are formed by P5 through P8. The factor of two is produced by the 1.8K resistors in series with diode connected transistor P5. The lower resistor, which results from a "cross under", used in the chip layout, combines with the 1.8K emitter resistors to make the mirrored currents twice the value of Ib.

The collector current of P6 is used by the comparator circuitry. The collector current of P7 is used by the ramp reset circuitry, while the collector current of P8 is the ramp capacitor charging current.

The current sources P10 through P11 are used by the gate disable circuit. The Schottky diodes S3 and S4 are used to prevent saturation of P10 and P11 which would be otherwise possible because of the associated circuitry.

Multiplier Circuit

Figure 5:
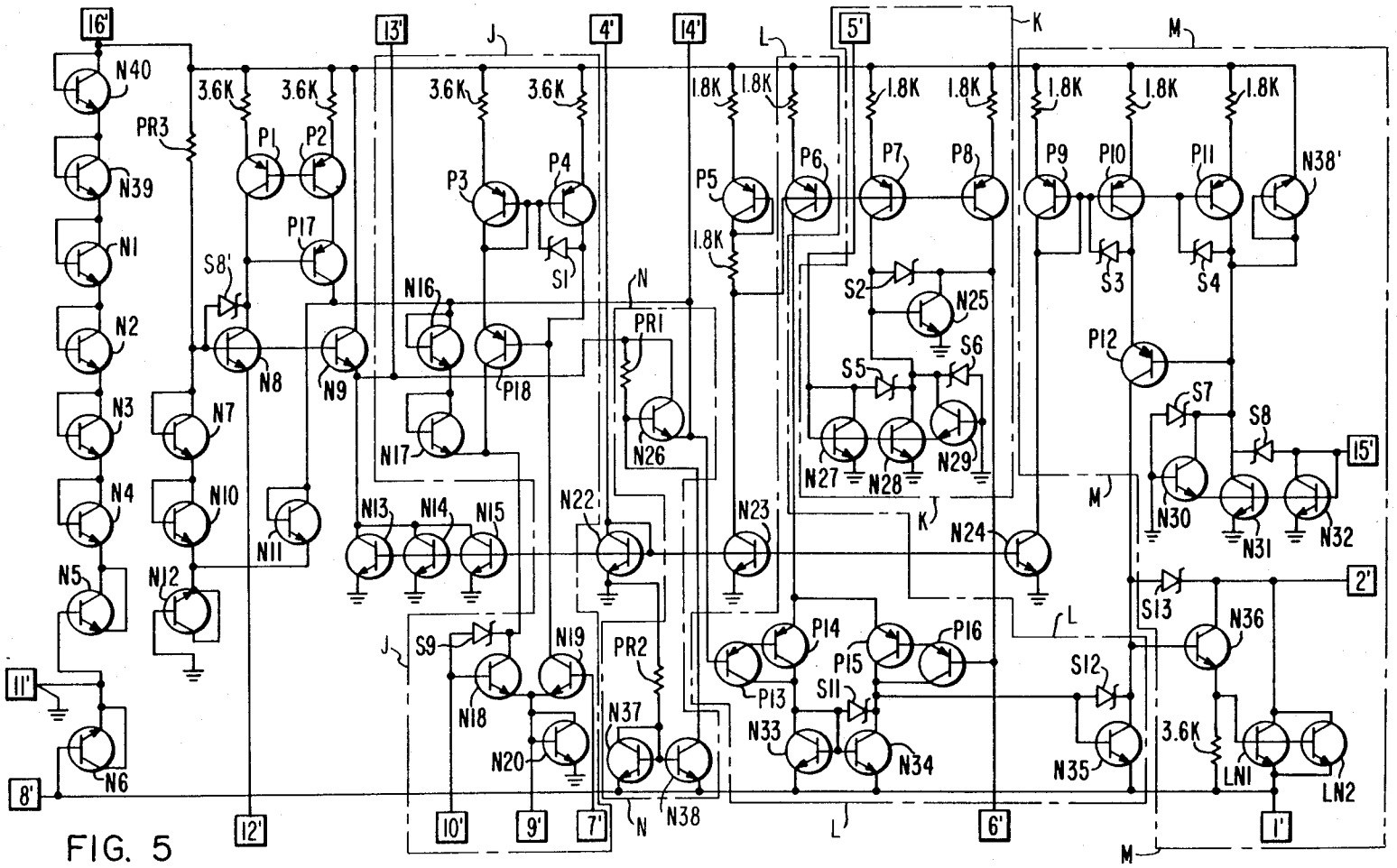
FIG. 5 is a circuit diagram similar to FIG. 4 except that separate sections are shown for other individual circuit portions of the I.C. chip.

The multiplier circuit is designated by the block J shown in FIG. 5. The differential transistor pair N18 and N19 has a differential collector current output which is proportional to the difference in base voltage multiplied by the common emitter current. The base voltage is made proportional to lamp current and the current flow from $V_L$ terminal 9' is proportional to lamp voltage. The collector current of N19 is mirrored by the circuit formed by P3, P4 and P18 such that the collector current of N18 minus the collector current of P18 is proportional to lamp power. This difference current flows through N16 and N17 to the INTEGRATING CAP terminal 14'.

Schottky diodes S1 and S9 are used to prevent a transistor saturation and thus substrate current. Diode connected transistor N20 is used to limit the voltage at $V_L$ terminal 9' during the positive half cycles of the lamp voltage.

Ramp Generator

The ramp generator is designated by the block K shown in FIG. 5. The collector current of P8 provides a constant charging current of about 20 μA. A zero crossing ramp reset circuit is formed by transistors N25 and N27 through N29. Transistor N25 is turned on by the collector current of P7 whenever the current into ramp reset terminal 5' falls below 2 Ib (approximately 20 μA). If the current into terminal 5' is greater than 2 Ib, the mirrored value of N28 exceeds that of P7 and thus the base of N25 is clamped near circuit ground. If the current out of terminal 5' exceeds 2 Ib, transistor N29 clamps the base of N25 to ground.

Comparator

The comparator is shown in block L in FIG. 5. Transistors P13 through P16 form a Darlington-connected differential transistor "pair". The collector current of P6 provides a constant bias current of 2 Ib. If the base voltage of P16 is below that of P13, P15 is "on" more than P14 which means that the current of N34 tries to exceed that of N33. The excess current flows into N35 which, in turn, clamps the base of N36 to ground and prohibits gate current.

As the ramp voltage increases, the voltage at the base of P16 increases to the point where it exceeds the voltage at the base of P13. At this time, N34 is turned on, N35 is turned off and transistor N36 can be turned on if the disabling circuit permits same.

Gate Drive and Disabling Circuit

The gate drive and disabling circuit is shown in the block M in FIG. 5. The disabling circuit is formed by the transistors P9 through P12 and N30 through N32. When the current into or out of the GATE DISABLE terminal 15'exceeds Ib, the collector current of N30 or N31 exceeds the collector current of P11. This turns P12 on to a value of Ib which, if N35 is off, will turn N36, LN1 and LN2 on, which results in gate current for the AC switch.

Reset Circuit

The reset circuit is shown in the block N in FIG. 5. If the line voltage drops appreciably, this will be reflected in a voltage drop across the primary ballast capacitor $X_C$, see FIG. 3. During such voltage drops, it is highly desirable to disengage the gate pulse mechanism and this is accomplished by the transistors N37, N38 and N26. N26 connects to the +E terminal 13' and the integrating capacitor terminal 14' so that when N26 is turned on, the integrating capacitor C4 (FIG. 3) exhibits that predetermined potential which is present upon initial energization of the apparatus in order that no gate pulses are generated. Thereafter, the error signals again slowly modify the potential at the one terminal of the integrating capacitor so that it is indicative of the magnitude of the integrated error signals.

In the following Table II is a listing of the I.C. pins as identified by their general label and the function which is performed at each pin.

TABLE II

| PIN | LABEL | DESCRIPTION OF I.C. PINS FUNCTION |
|---|---|---|
| 1' | GATE− | Negative (Emitter) side of 200 mA NPN Switch which is used to turn the AC switch on by connecting the gate to a negative voltage source. |
| 2' | GATE+ | Positive (Collector) side of NPN Switch |
| 3' | Not Used or Shown | |
| 4' | BIAS | Current $I_b$ into this terminal forms a source for various internal biasing circuits and current references. The value of $I_b$ can range from 5 to 50 μA. The voltage at the terminal is 0.7 V above GND terminal 15'. |
| 5' | RAMP RESET | Whenever the magnitude of the current in or out of this terminal drops below 2 $I_b$, the RAMP CAP terminal 6' is shorted to the GND terminal 15' by an NPN transistor. Maximum current should be limited to ± 300 μA. The voltage clamps at ± 0.7 V. |
| 6' | RAMP CAP | The current flow out of this terminal equals 2 $I_b$ and is used to turn a linear voltage ramp signal. The voltage range is from ≈ O V (reset active) to ≈ + V. The voltage at this terminal is internally compared with the voltage at INTEGRATING CAP terminal 14' to control the gate current. |
| 7' | $I_{L-}$ | The voltage difference between this terminal and $I_{L+}$ is used in combination with the current flow out of $V_L$ terminal 9' to form a transconductance multiplier whose output is proportional to instantaneous lamp power. The multiplier is a single quadrant design which functions when $I_{L+} - I_{L-}$ is > 0 (for best linearity <30 mV) and the current from VL terminal is positive. In the lamp voltage regulating configuration the multiplier is converted to a single transistor, grounded base, network whose output equals the current flowing from $V_L$ terminal 9' This is accomplished by connecting $I_{L-}$ to $V_L$ and grounding $I_{L+}$. |
| 8' | −V | Negative shunt regulator referenced to GND terminal 11' Voltage is nominally −6.7 V. Current flow from terminal 8' should be limited to less than 10 mA. The substrate of the chip is connected to −V and thus all other chip terminals must be positive with respect to −V. |
| 9' | $V_L$ | See description of Pin 7'. |
| 10' | $I_{L+}$ | See description of Pin 7'. |
| 11' | GND | Ground reference of circuit |
| 12' | REFERENCE | Voltage at this terminal (nominal value of 7.4 V) is temperature compensated and independent of the ripple voltage of +V terminal 16'. The current flow from this terminal is internally compared to the output of the multiplier and thus forms the power reference signal. Current should nominally be 10–20 μA. |
| 13' | +E | Voltage at this terminal is nominally 7.4 V. Terminal can source about 300 μA and can sink 3 $I_b$ and can thus handle ripple current of the integrating capacitor. |
| 14' | INTEGRATING CAP | This high impedance terminal is the summing point for the current proportional to lamp power and the power reference $I_{REF}$. Voltage can range from 1 V to 7.4 V. |
| 15' | GATE DISABLE | The AC switch gate current circuit is disabled whenever the current flow from or to this terminal exceeds $I_b$. The current should be limited to ±300 μA and the voltage is internally limited to ±0.7 V. |
| 16' | +V | A shunt 10.9 V Zener referenced to GND terminal 11'. The current flow should be limited to 10 mA and the terminal be most positive of chip. |

In the following Table III is a general description of the components of the I.C. chip.

TABLE III

| DESCRIPTION OF I.C. CHIP COMPONENTS | |
|---|---|
| Chip Component | Description |
| N 1 through 40 | NPN transistors (signal level) |
| P 1 through 18 | PNP transistors (signal level) |
| S 1 through 13 | Schottky diodes |
| LN1 and LN2 | Medium power level NPN transistors |
| PR1 and PR2 | Pinch resistors 130 KΩ |
| PR 3 | Pinch resistor 100 KΩ |
| Other resistors | 3.6 KΩ or 1.8 KΩ as marked |

Figure 6:
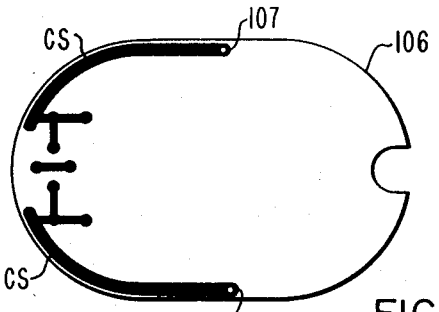
FIG. 6 is a top view of the printed circuit board used for the module shown in FIG. 3 wherein an elongated copper printed circuit conductor member is used for purposes of current sensing.
Figure 7:
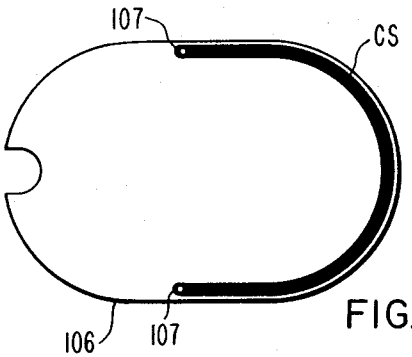
FIG. 7 corresponds to FIG. 6 except that it shows a bottom view of the printed circuit board and illustrates another portion of the current sensing copper printed circuit conductor.

As indicated hereinbefore, the lamp current sensing is accomplished by an elongated copper conductor strip CS on the printed circuit board and this is shown in detail in FIGS. 6 and 7. Half of the copper strip CS is carried on the top surface of the board 106 as shown in FIG. 6 and the remainder of the copper strip CS is carried on the bottom surface of the board 106 as shown in FIG. 7. These two strip portions are connected in series by means of plated-through holes 107 to form an elongated copper resistor strip having a length of approximately 7 inches (17.8 cm) and a width of approximately 1/16 inch (0.16 cm). Normally it is not practical to use a copper track as a current sensor because of the positive temperature coefficient of resistance of copper. For this application, however, the positive temperature coefficient of resistance of the copper track CS is compensated by the negative temperature coefficient of the input transistors in the multiplier.

CLOCK MODULE

Figure 8:
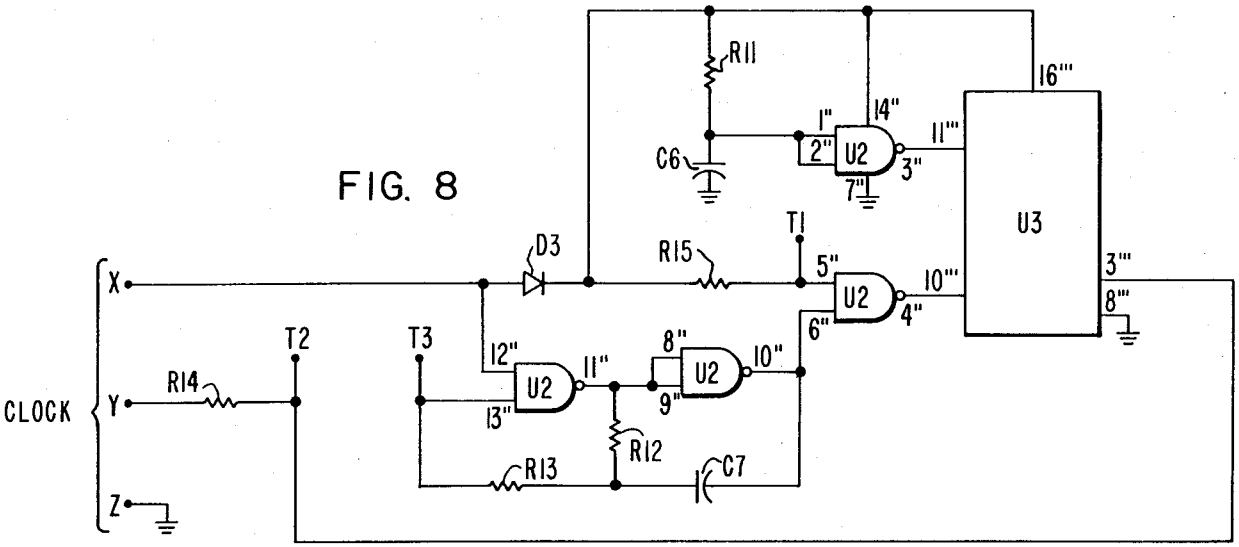
FIG. 8 is a circuit diagram of a clock module which may be used as a part of the control in order to dim the lamps after a predetermined period of operation.

In order to conserve power for certain applications such as street and highway lighting, it is desirable to dim the lamps after the evening rush hour and thereafter, in the case of long winter nights, to operate the lamps at full brightness again during the early morning rush hours. This is accomplished by affixing a counter or clock module to the power regulating module at the terminals designated X, Y and Z in FIG. 3, with the circuit diagram for the clock module shown in FIG. 8. This lamp dimmer essentially is a timer which is formed by the quad Schmitt trigger dual input NAND gate U2 and the 14-stage binary ripple counter U3. The terminals for U2 are marked 1'' through 14'' and the terminals for U3 are marked 3''', 8''', 10''', 11'''' and 16'''. Resistor R12 and capacitor C7 set the oscillator period to about 2.2 seconds. The counter then produces an output at terminal 3''' which is "low" for $\frac{1}{2}\times 2.2\times 2^{14}$ which is about five hours. During this time, when the output is low, current will flow through R14 from the chip U1 REFERENCE terminal 12' (FIG. 3). After five hours, the voltage at terminal 3''' goes "high" and the current through R14 drops to a low value. The power reference signal is thus reduced and by design, the reduction is set at about 20%. Thus, the counter or timer as shown in FIG. 8 is initially actuated by initial energization of the apparatus and remains passive for a first predetermined period of time, such as five hours.

At the end of the first predetermined period of time, a power-on reset for the timer is achieved by the circuitry consisting of D3, R11 and C6. With C6 initially discharged, the terminal 11''' of chip U3 is "high". After about three seconds, the reset is removed and the counter is enabled. During this period, terminal 12' of the basic chip U1 is "high" thus energizing the 2.2 second oscillator of the counter. Should the power momentarily fail, the oscillator enable is removed, thus stopping the oscillator. The power supply of the counter, terminal 16''' of counter U3 is supplied by the charge on C6. The count is thus retained. Capacitor C6 will be slowly discharged by current flow into the power supply terminals of U2 and U3. This current is very low as the CMOS chips are in a static condition at this time. The timer can thus survive short power outages as can occur during an electrical storm.

In summer time, when the nights are shorter than ten hours, the lamps thus initially operate with full brightness for the first five hour period and are then dimmed for the remainder of the night. During the long winter nights, however, the lamps operate with full brightness for the first five hour period and are then dimmed by 20% for the second five hour period. Thereafter, at the end of the second five hour period, the lamps are restored to their normal rated brighness. In effect, the counter operates to change the potential at terminal 14' of the integrating capacitor C4 (FIG. 3) by a predetermined amount in order to cause the AC switch 56 to turn "on" a predetermined amount earlier in each half cycle of AC energizing potential, in order to decrease the average power consumed by an operating lamp.

In the following Table IV are listed the components parts for the clock module.

TABLE IV

PARTS LIST

| COMP DESCRIPTION | VALUE | | | MFG. NUMBER | MFG |
|---|---|---|---|---|---|
| R11 Resistor | 1 M | 5% | .25 W | | |
| R12 Resistor | 680K | 5% | .25 W | | |
| R13 Resistor | 680K | 5% | .25 W | | |
| R14 Resistor | 4.3 M | 5% | .25 W | | |
| R15 Resistor | 1 M | 5% | .25 W | | |
| C6 Capacitor | 4.7 MFD | 20% | 15 V | 196D475X0015JA1 | Sprague |
| C7 Capacitor | 1 MFD | 10% | 50 V | RA1A105K | IBM |
| D3 Diode | 400 mA | | 225 V | 1N645 | Gen Inst |
| U2 Integrated Ckt | Quad Nand | | | MC14093B-CL | Motorola |
| U3 Integrated Ckt | 14 Stage Counter | | | MC14020B-CL | Motorola |
| Printed Circuit Board | A81160 | | | | |
| T1, T2, T3 Test Points | | | | | |

VOLTAGE REGULATING MODULE

Figure 9:
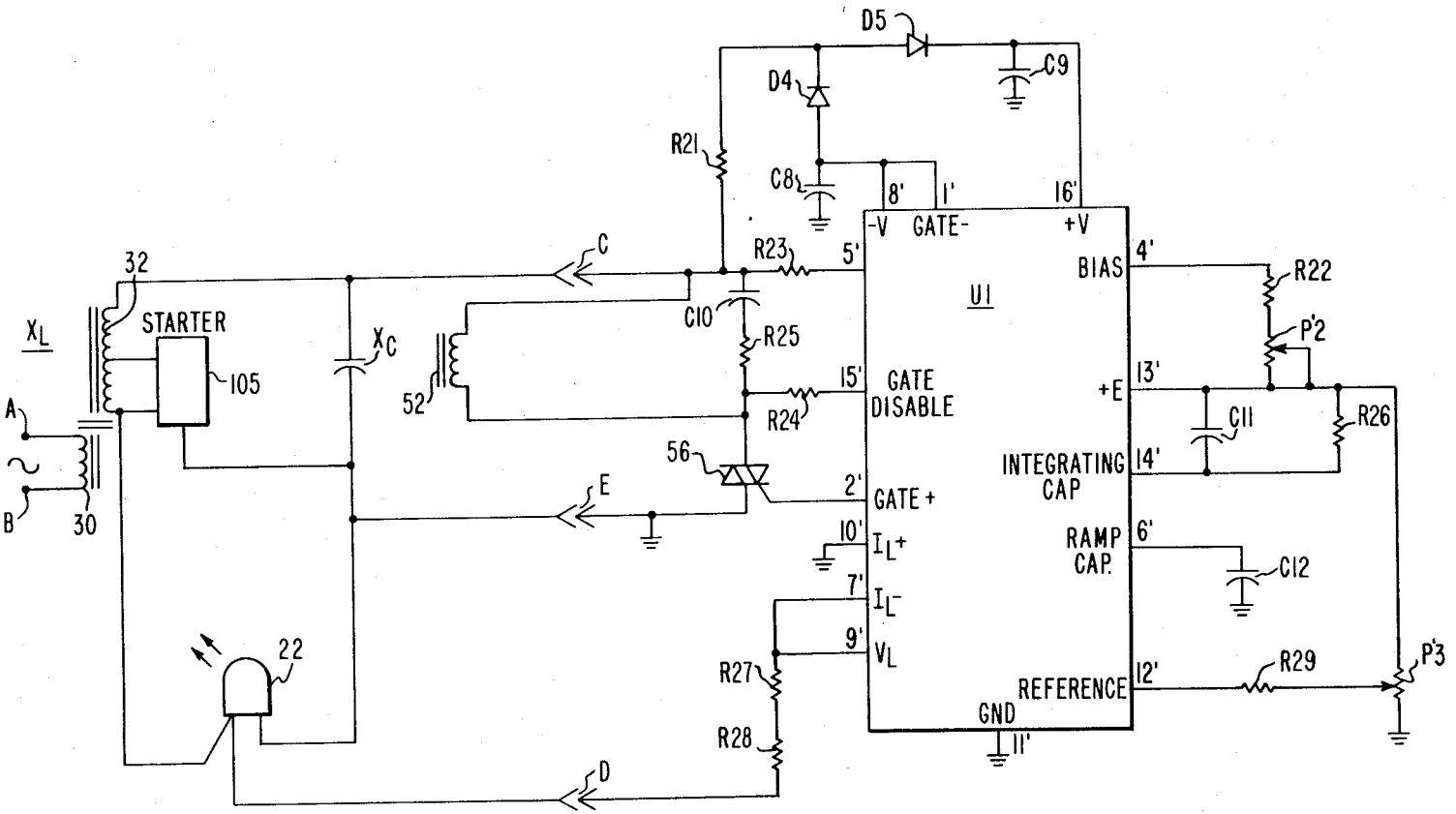
FIG. 9 is a circuit diagram of a control module wherein lamp voltage is sensed in order to control lamp wattage.

In some types of HID sodium lamps which are designed for improved color rendition, such as described in U.S. Pat. No. 4,230,964, dated Oct. 28, 1980 to Bhalla, the lamp may exhibit an emission color which is subject to change with substantial increases in operating lamp voltages as are normally encountered during normal lamp life. In such case, it is desirable to minimize the lamp voltage changes as much as possible. This is accomplished by modifying the present device so that the lamp operating voltage is periodically measured in order to generate output signals which are representative of the measured voltages developed across the operating lamp. These are used to actuate means which cause the gate drive to be actuated at a predetermined earlier time in each half cycle of the AC energizing potential as the measured lamp voltage increases. In other words, as the lamp operating voltage increases, the lamp wattage consumption is decreased at a predetermined rate in order that the lamp voltage increase is minimized. Thus the modified control senses lamp voltage rather than lamp wattage and reduces the lamp power once the voltage has passed a value of about 110 V AC in the case of a lamp rated at 100 V AC. Once wattage control is in effect, a representative decrease, when plotted on a curve of watts versus volts will display a negative slope of about −1% of power/one volt increase in lamp operating voltage. The circuit diagram for the voltage control module is shown in FIG. 9 wherein the conventional lead-type ballast circuit is as explained before. Connections are made to the terminals C, D and E as shown in FIG. 1. The unit as shown responds to lamp voltage rather than lamp power and the current sensing shunt as was used in the previous embodiment is dispensed with. In addition, the objective of regulating the voltage requires that the integrating error detector be modified. This is achieved by the addition of resistor R26 across the integrating capacitor C11. The voltage which appears across C11 is "zero" until the lamp is warmed up and its operating voltage achieves a value of about 110 V AC. At this time the lamp voltage signal begins to exceed the reference signal causing the voltage across C11 to increase. This in turn causes the AC switch to turn on which in turn reduces the lamp power, thereby reducing the tendency for lamp voltage increase. The current through R26 is proportional to the voltage across C11 and is of the same polarity as the internal reference current which flows toward the INTEGRATING CAP, terminal 14'. The current through R26 therefore has the effect of increasing this reference value.

Two adjustments P'2 and P'3 are provided. Potentiometer P'2 is used to adjust the bias current into BIAS terminal 4'. The ramp capacitor charging current equals twice the bias current and thus the ramp height can be adjusted. The maximum height is set equal to +E which provides a uniform slope for the lamp power versus voltage curve. The second potentiometer P'3 sets the lamp voltage value at which the control becomes active. At the present time, for a lamp having a nominal voltage of 100 volts, the control is set to become operative when the lamp operating voltage reaches a value of about 110 V AC.

The semi-custom integrated chip U1 is identical with the chip as described in the previous power control embodiment.

In the following Table V is set forth the parts list for the voltage module as illustrated in FIG. 9.

TABLE V

| COMP DESCRIPTION | VALUE Ω | | | MFG. NUMBER | MFG. |
|---|---|---|---|---|---|
| R21 Resistor | 100K | 5% | 2 W | | |
| R22 Resistor | 330K | 5% | .25 W | | |
| R23 Resistor | 4.7 M | 5% | .25 W | | |
| R24 Resistor | 4.7 M | 5% | .25 W | | |
| R25 Resistor | 2K | 5% | .25 W | | |
| R26 Resistor | 680K | 5% | .25 W | | |
| R27 Resistor | 2.7 M | 5% | 1 W | | |
| R28 Resistor | 2.7 M | 5% | 1 W | | |
| R29 Resistor | 330K | 5% | .25 W | | |
| C8 Capacitor | 18 MFD | 20% | 15 V | 196D186X0015JA1 | Sprague |
| C9 Capacitor | 18 MFD | 20% | 15 V | 196D186X0015JA1 | Sprague |
| C10 Capacitor | .028 MFD | 5% | 600 V | 715P3358LD3 | Sprague |
| C11 Capacitor | 1 MFD | 10% | 50 V | RA1A105K | IBM |
| C12 Capacitor | .015 MFD | 20% | 50 V | CW15-50-100-M | Central Lab |
| D4 Diode | 400 mA | | 225 V | 1N645 | Gen Inst |
| D5 Diode | 400 mA | | 225 V | 1N645 | Gen Inst |
| P'2 Potentiometer | 1 M | 10% | 1 Turn | 3386-P-1-105 | Bourns |
| P'3 Potentiometer | 500K | 10% | 1 Turn | 3386-P-1-504 | Bourns |
| 56 AC Switch | 4 A | | 600 V | Q6004 L4 | Teccor |
| U1 Integrated Ckt | | | | MOA2953 | Interdesign |
| Printed Circuit Board | | | | A81164 | |
| Terminals | | | | 62409-1 | AMP |

THE ADD-ON INDUCTOR

The preferred packaging for both the add-on inductor and the control circuitry in a unitary member formed as a conventional capacitor can, in order to facilitate mounting of same in a conventional luminaire which usually has provision for mounting a second capacitor, but which normally is not needed. This is disclosed in further detail in previously referenced copending application Ser. No. 414,275, filed concurrently therewith. Since the circuit is so designed that the control device is not operated until the lamp is warmed up, the add-on inductor 52 can be wound to operate at the maximum capacitor voltage ($X_C$) expected with minimum lamp voltages, typically in the order of about 80 volts. In practice, the size of the series capacitor $X_C$ increases with increasing ballast rating. At a given lamp voltage, the higher current encountered with increasing ballast rating thus produces approximately the same voltage drop across the series ballast capacitor $X_C$. Thus every ballast rating will have the same maximum voltage rating for the add-on inductor 52.

The actual value of the inductor 52 is not critical. The only requirement is that, with the reactor control fully phased "on", the control can prevent the lamp watts exceeding the predetermined desired value with +10% input voltage. Any lower value of inductance will effectively increase the gain of the system since the switch 56 will not have to phase forward as much to obtain the same control level.

For the power control function, the same value of inductor 52 is used for all ballast power ratings, i.e., the ratio of the impedance presented by the reactor 52 and capacitor $X_C$ in parallel, compared to the impedance of the capacitor $X_C$ alone, is approximately the same for all ballast power levels. Since power in the lamp is proportional to lamp current (at a given lamp voltage), the same percentage change can be made in lamp current for any ballast rating. A typical rating for the inductor 52 is 159 mH. For use with the voltage control module, the same inductor 52 can be used.

LAMP AND BALLAST PERFORMANCE

Figure 10:
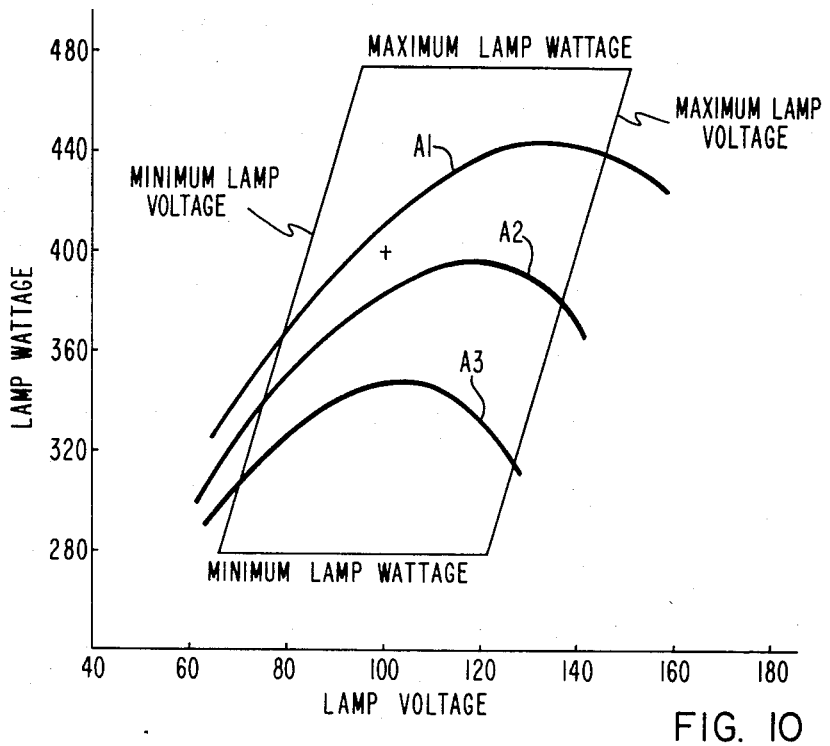
FIG. 10 is a graph of watts versus volts for an HID sodium lamp showing the typical lamp performance throughout life which is normally obtained with a conventional and unmodified lead ballast apparatus.

The lamp industry, through the American National Standards Institute, has established operating standards for high pressure sodium lamps. These standards have taken the form of a trapezoid wherein lamp wattage is plotted on the ordinate and lamp voltage is plotted on the abscissa and a so-called ANSI trapezoid for a 400 watt sodium lamp is plotted on FIG. 10. In the operation of the lamp, the operating curve enters the trapezoid on the left and exits the trapezoid on the right toward the end of lamp life. Shown plotted on the curve in FIG. 10 are typical operating characteristics for a 400 watt sodium lamp which has a nominal operating voltage of 100 volts, with the nominal operating conditions indicated as (+). Such lamps when operated from a lead ballast have characteristics which are represented by the humped curves shown in FIG. 10 wherein the uppermost curve A1 represents the lamp operating characteristic at 10% above rated line volts, the middle curve A2 is the lamp operating characteristic at rated line volts and the bottom curve A3 is the lamp operating characteristic at 10% below rate line volts.

Figure 11:
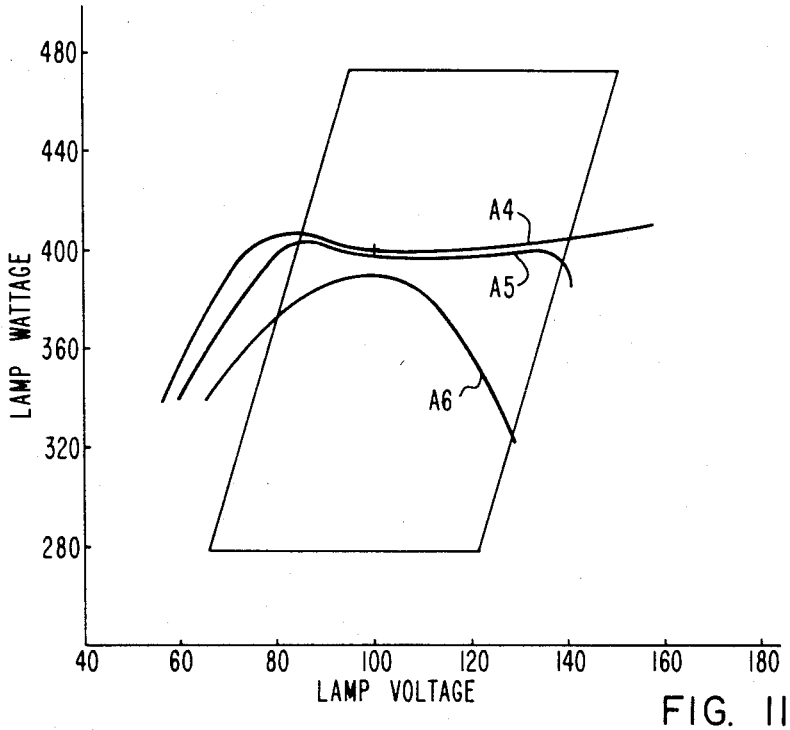
FIG. 11 is a graph similar to that shown in FIG. 10 showing lamp performance which is obtained with the lead ballast modified in accordance with the present invention.

When the conventional lead ballast is modified with the addition of the power regulating module as described hereinbefore, and the capacitor $X_C$ is changed from 48 MFD to 52 MFD, the lamp characteristic curves are modified so that the wattage essentially remains unchanged for 10% above line volts and for rated line volts and these characteristic operating curves are shown in FIG. 11, curves A4, A5 and A6. At 10% below rated line volts, curve A6, the wattage is still subject to some variation since the present control which places the add-on inductor in parallel with the capacitor can only decrease power when it is included in circuit.

Figure 12:
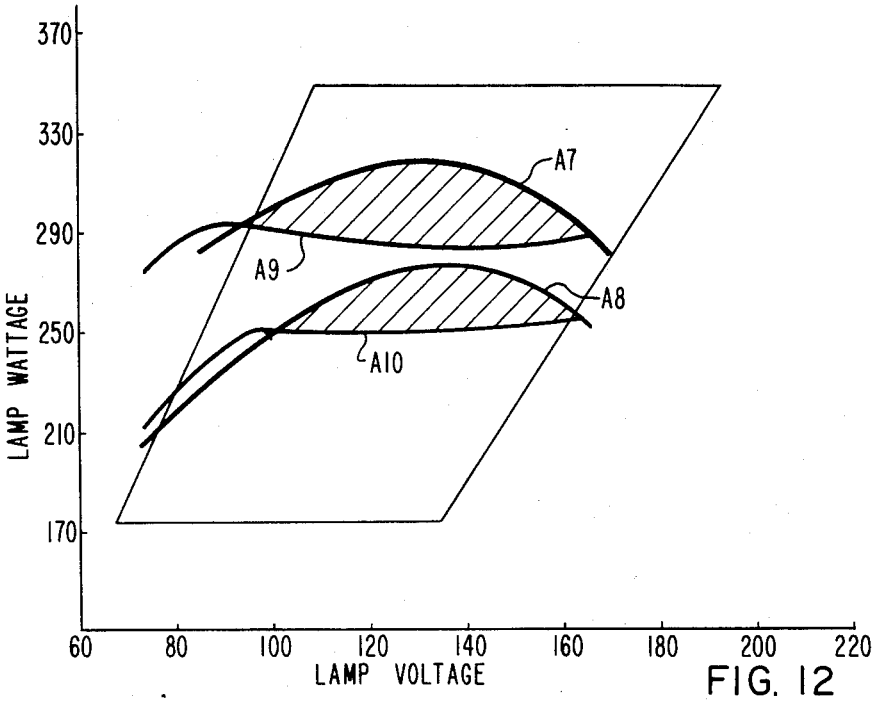
FIG. 12 is a graph of lamp wattage versus lamp voltage showing the power savings which are obtained using the present modified ballast.

In FIG. 12 are shown the operating curves for a 250 watt sodium lamp operating on a lead ballast wherein the upper humped curve A7 is the wattage input to the entire fixture unit and the lower humped curve A8 is the wattage input to the lamp per se. When the same ballast was modified by the addition of the present add-on wattage module, the lower curves A9 and A10 were obtained and the hatched portion between the two curves represents the power savings. This essentially amounts to about a 20% power savings over the life of the lamp and if the part-of-the-night dimming feature is utilized, this will add approximately another 10% to the power savings.

Figure 13:
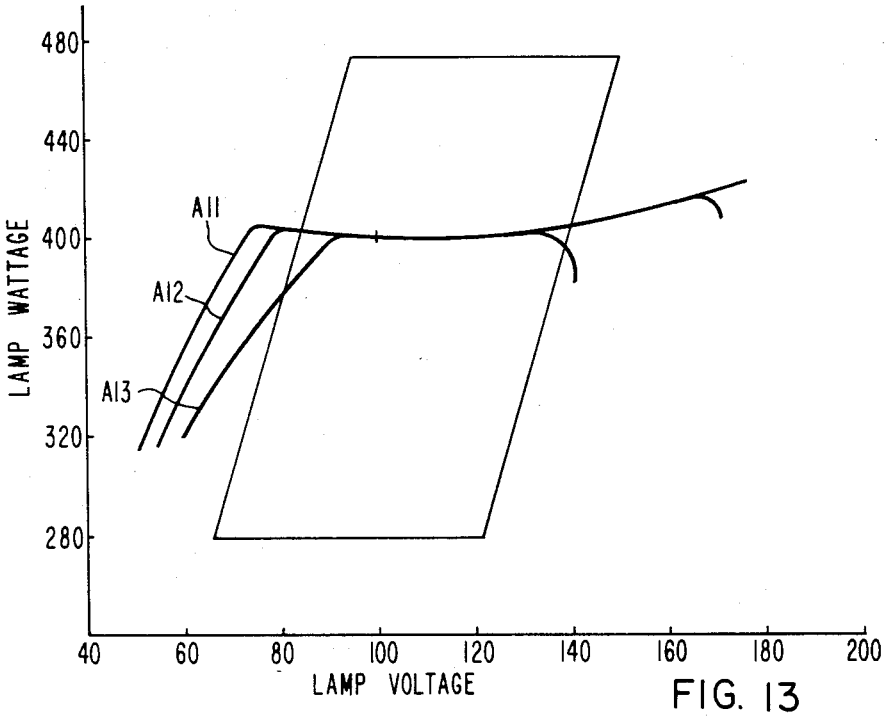
FIG. 13 is a graph of lamp wattage versus lamp voltage showing the accurate control of lamp wattage which can be obtained by slightly modifying the basic lead ballast design and then controlling same with the present sensing and programming device.

If it is desired to exercise careful control over the lamp operation under all conditions of voltage variations, the shunt in the high reactance transformer of the conventional lead ballast can be modified slightly along with the capacitor value to raise the overall operating power levels for the unmodified ballast. When the present power control module is added to this modified lead ballast, a very accurate control of the wattage can be obtained and this is shown in FIG. 13 wherein the left-hand curve A11 indicates lamp performance at 10% above rated line volts, the middle curve A12 indicates lamp performance at rated line volts and the right-hand curve A13 indicates lamp performance at 10% below rated line volts. Throughout the majority of the lamp life, the wattage is essentially unchanged and this is independent of variations in line voltage.

Figure 14:
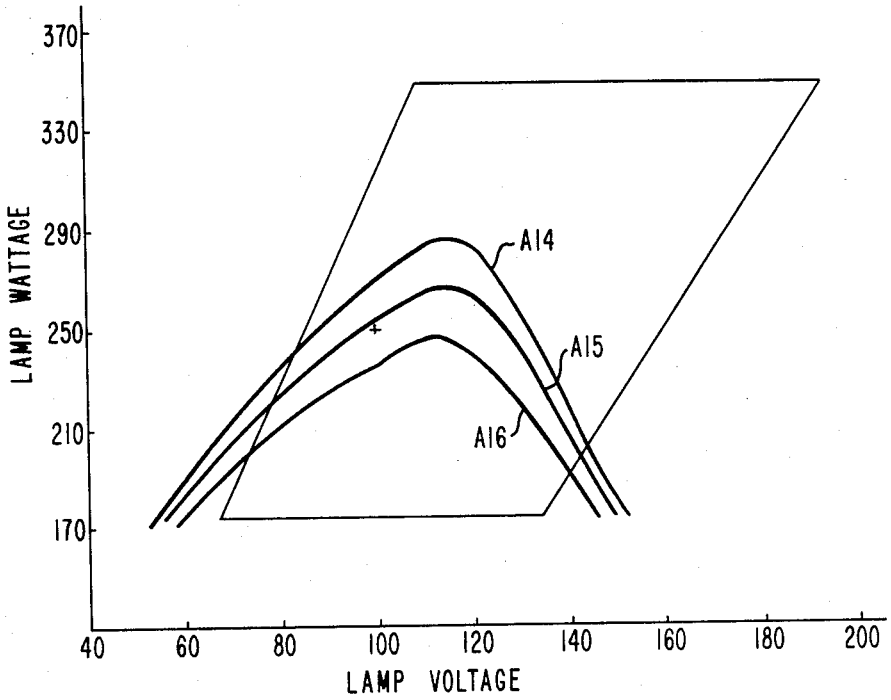
FIG. 14 is a similar graph of watts versus volts showing the performance of a lamp operated with the voltage control module in order to minimize lamp voltage change throughout life.

In FIG. 14 are shown a similar curve for operation of a 250 watt sodium lamp and a lead ballast with the voltage regulation module added thereto. For this embodiment, control is effective after a lamp potential of approximately 115 volts is realized. Thereafter, the lamp wattage consumption is decreased in response to increasing lamp voltage so that the total lamp voltage increase is minimized in order to minimize color shifts in the operating high pressure sodium lamp. The three curves shown in FIG. 14 represent 10% high line voltage in the upper curve A14, rated line voltage curve A15 and 10% low line voltage in the lower curve A16.

I claim:

1. In combination with a lead-type ballast apparatus for operating a high-intensity-discharge lamp, an improved device for modifying said ballast apparatus in order to program and control the operating performance of the high-intensity-discharge lamp as operated by said modified ballast apparatus;

said lead-type ballast apparatus having apparatus input terminals adapted to be connected across a source of AC energizing potential and apparatus output terminals across which said lamp to be operated is adapted to be connected;

said lead-type ballast apparatus comprising an inductive reactance portion and a capacitive reactance portion, said inductive reactance portion comprising a current-limiting high-reactance transformer means having primary winding means connected to said apparatus input terminals and secondary winding means terminating in secondary winding means output terminals, said capacitive reactance portion comprising capacitor means connected in circuit between said secondary winding means output terminals and said apparatus output terminals;

said modifying device comprising series-connected controllable AC semiconductor switching means and additional inductance means which are connected in parallel circuit with said capacitor means, said AC semiconductor switching means having a high impedance open position and a low impedance closed position and control terminal means, when said switching means is open said modified ballast apparatus delivers a first level of current to an operating lamp, and when said switching means is closed said modified ballast apparatus delivers a second and lower level of current to an operating lamp;

sensing and programming means operable to sense at least one predetermined lamp operating parameter and to generate an output control signal which is indicative of a predetermined parameter desired for said operating lamp, said sensing and programming means having an output connected to the gate terminal means of said switching means to control the relative proportion of time said switching means is open and closed in order to control in programmed fashion the predetermined lamp operating parameter desired for said operating lamp, the improved sensing and programming means comprising:

parameter measuring means operable to periodically measure the value of said lamp operating parameter to be controlled and to convert the measured values of said parameter into output electrical signals of a magnitude which varies in accordance with the measured values of said parameter;

error signal generating means for comparing said output electrical signals to a reference signal to generate error signals which are indicative of whether the measured values of said parameter are equal to or less than or greater than the desired value for said measured parameter;

integrating capacitor means having one terminal portion connected to receive said generated error signals, means for causing said one terminal portion of said integrating capacitor means to exhibit a predetermined potential upon initial energization of said apparatus, with said initial predetermined potential thereafter slowly modified by said received error signals to a potential which is indicative of the magnitude of the integrated error signals;

ramp generator means which includes a ramp capacitor, for causing said ramp capacitor to exhibit a gradually changing potential each half cycle of said AC energizing potential, said gradually changing ramp capacitor potential normally crossing over the value of that potential developed at said one terminal portion of said integrating capacitor means which is indicative of the magnitude of the integrated error signals, and said gradually changing ramp capacitor potential not crossing over the value of that predetermined potential which is exhibited at said one terminal portion of said integrating capacitor means when said apparatus is initially energized;

comparator means for comparing the potential at said one terminal of said integrating capacitor means with the potential developed across said ramp capacitor to generate a comparator signal output whenever the changing potential of said ramp capacitor crosses over the value of the integrated error-signal potential at said one terminal portion of said integrating capacitor means; and drive means connected to said control terminal means of said switching means and responsive to said comparator means signal output to generate a drive signal to turn said switching means "on", whereby during lamp start-up and warm-up said switching means is maintained in an "off" condition by the initial predetermined potential exhibited at said one terminal portion of said integrating capacitor means to prevent the application of the high voltages developed across said ballast capacitor means during lamp start-up and warm-up from being applied across said additional inductance means.

2. The combination as specified in claim 1, wherein disabling means is responsive to current flow through said switching means to rapidly render said drive means inoperative thereby reducing power requirements for said drive means.

3. The combination as specified in claim 1, wherein reset means is responsive to a drop in said AC energizing potential to cause said one terminal portion of said integrating capacitor means to be reset to that potential exhibited at said one terminal portion when said apparatus is initially energized.

4. The combination as specified in claim 1, wherein said lamp operating parameter to be controlled is the operating lamp wattage, said parameter measuring means has a voltage-responsive portion to generate a first signal which is representative of the voltage developed across said operating lamp, said parameter measuring means has a current-responsive portion to generate a second signal which is representative of the current through said operating lamp, and means for periodically multiplying said first signals and said second signals to generate said output electrical signals which represent the then-measured values of wattage consumed by said operating lamp.

5. The combination as specified in claim 4, wherein said parameter-measuring means comprise semiconductor means having a negative temperature coefficient of resistance, and electrical elements incorporated as a part of an I.C. chip, said current-responsive portion comprises a copper strip of relatively low resistance which is formed as a part of a printed circuit board, said printed circuit board and said I.C. chip being in heat transfer relationship with respect to one another so that said printed circuit board and said I.C. chip are maintained at approximately the same temperature, said copper strip is electrically connected in series with said operating lamp so that the voltage drop thereacross is a measure of the operating lamp current, said copper strip has a positive temperature coefficient of resistance which is compensated by the negative temperature coefficient of resistance for said semiconductor means which comprise said parameter-measuring means, whereby said copper strip and said parameter sensing means compensate one another.

6. The combination as specified in claim 4, wherein timing means connects to said sensing and programming means, said timing means is actuated by initial energization of said apparatus to remain passive for a first predetermined period of time, and after passage of said first predetermined period of time, said timing means operates to change the average potential at said one terminal of said integrating capacitor means by a predetermined amount to cause said switching means to turn "on" a predetermined amount earlier in each half cycle of said AC energizing potential, thereby to decrease the average power consumed by an operating lamp.

7. The combination as specified in claim 6, wherein after said lamp has operated with a decreased average power for a second predetermined period of time, said timing means again becomes passive to restore said lamp to its normal controlled mode of operation.

8. The combination as specified in claim 1, wherein said lamp is a high-intensity-discharge sodium lamp.

9. The combination as specified in claim 1, wherein said lamp is a high-intensity-discharge sodium lamp which exhibits an emission color which is subject to change with substantial increases in operating lamp voltages as are normally encountered during normal lamp life, said parameter measuring means is operable to periodically measure the value of said lamp operating voltage and to generate output signals which are representative of the measured voltages developed across said operating lamp, so that said drive means is actuated at a predetermined earlier time in each half cycle of said AC energizing potential as the measured lamp voltage increases, whereby lamp power consumption is decreased at a predetermined rate with increasing lamp voltage.

* * * * *